US006851438B2

(12) United States Patent
Battiston

(10) Patent No.: US 6,851,438 B2
(45) Date of Patent: Feb. 8, 2005

(54) ERGONOMIC CRUTCH

(75) Inventor: Joseph Battiston, Chester, VA (US)

(73) Assignee: Tubular Fabricators Industry, Petersburg, VA (US)

( * ) Notice: Subject to any disclaimer, the term of this patent is extended or adjusted under 35 U.S.C. 154(b) by 0 days.

(21) Appl. No.: 10/428,665

(22) Filed: May 2, 2003

(65) Prior Publication Data

US 2004/0069337 A1 Apr. 15, 2004

Related U.S. Application Data

(63) Continuation of application No. 10/214,699, filed on Aug. 8, 2002, now Pat. No. 6,601,599, and a continuation of application No. 09/886,903, filed on Jun. 21, 2001, now abandoned, which is a continuation of application No. 09/624,821, filed on Jul. 25, 2000, now Pat. No. 6,470,902, which is a continuation of application No. 09/490,860, filed on Jan. 24, 2000, now Pat. No. 6,382,224, and a continuation-in-part of application No. 09/277,250, filed on Mar. 26, 1999, now Pat. No. 6,076,312, which is a continuation of application No. 09/181,127, filed on Oct. 28, 1998, now abandoned, which is a continuation of application No. 09/131,148, filed on Aug. 7, 1998, now Pat. No. 6,041,800, which is a continuation of application No. 09/025,897, filed on Feb. 18, 1998, now Pat. No. 5,921,260, and a continuation of application No. 08/823,616, filed on Mar. 25, 1997, now Pat. No. 5,797,412, and a continuation of application No. 08/604,801, filed on Feb. 23, 1996, now Pat. No. 5,632,293, and a continuation of application No. 08/279,476, filed on Jul. 25, 1994, now Pat. No. 5,511,572.

(51) Int. Cl.[7] ..... A61H 3/02

(52) U.S. Cl. ..... 135/72; 135/69; 135/71; 135/73; 135/75

(58) Field of Search ..... 135/65, 68, 69, 135/71–73, 75, 76

(56) References Cited

U.S. PATENT DOCUMENTS

| | | | | | |
|---|---|---|---|---|---|
| 2,408,604 | A | * | 10/1946 | Brickson | 135/69 |
| 2,568,654 | A | * | 9/1951 | Neptune | 135/69 |
| 2,736,330 | A | * | 2/1956 | Wood | 135/68 |

(List continued on next page.)

OTHER PUBLICATIONS

Royal Medical Supply Ambulatory Aids Page, Date of Domain name Registration for "a–royalmed.com": Dec. 31, 1997, web page downloaded on Dec. 13, 1998, URL= "http://www.a–royalmed.com/".

(List continued on next page.)

*Primary Examiner*—Winnie Yip
(74) *Attorney, Agent, or Firm*—Klauber & Jackson

(57) ABSTRACT

An ergonomically enhanced crutch that has a unitary upright member that is readily manufacturable and which has a upper section and a lower section that are generally straight sections. An intermediate section forms an indentation and a handle extends from the indentation outwardly for gripping by the patent. The crutch also includes an upper arm cradle that is affixed to the unitary upright member in a telescoping manner and its location is adjustable by the user to a comfortable position. Similarly, a bottom member is telescopingly affixed to the lower section and can be adjusted along the length of the lower section for the convenience and comfort of the patient. The upper arm cradle thus is angularly inclined upwardly in the direction the patient is facing to provide added comfort for the patient. The overall crutch adapts ergonomically to the needs and comfort of the patient and is adjustable by the user for that comfort yet is readily and inexpensive to manufacture through the use, where possible, of standard components.

7 Claims, 2 Drawing Sheets

U.S. PATENT DOCUMENTS

| | | | | | |
|---|---|---|---|---|---|
| 2,788,793 | A | * | 4/1957 | Abbott | 135/68 |
| D204,849 | S | * | 5/1966 | Thomas | D3/8 |
| 3,710,807 | A | * | 1/1973 | Ferry | 135/68 |
| 3,947,140 | A | * | 3/1976 | Thomas | 135/69 |
| 4,869,280 | A | * | 9/1989 | Ewing | 135/69 |
| 5,201,334 | A | * | 4/1993 | Tseng | 135/68 |
| 5,711,334 | A | * | 1/1998 | Roux | 135/65 |
| 5,725,005 | A | * | 3/1998 | Yamasaki et al. | 135/73 |

OTHER PUBLICATIONS (Walk–Easy Products, Date of Domain name Registration for "walkeasy.com": Sep. 7, 1996, web page download on Oct. 13, 1998, URL= "http://www.walkeasy.com/".

Fetterman, Date of Domain name Registration for "fetterman–crutches.com": Aug. 10, 1996, web page downloaded on Oct. 13, 1998, URL="http://www.fetterman–crutches.com".

* cited by examiner 28
24
26
30
32
32
14
10
20
22
18
42
16
36

28
26
A
30
34
24
Y
X
14
10
18
20
22
16
36
40

ERGONOMIC CRUTCH

This application is a continuation of Ser. No. 09/886,903 Jun. 21, 2001 abandoned which is a continuation of Ser. No. 09/181,127, filed on Oct. 28, 1998 abandoned.

This is a continuation of Ser. No. 10/214,699 filed Aug. 8, 2002 now U.S. Pat. No. 6,601,599 which is a continuation of Ser. No. 09/624,821 filed Jul. 25, 2000, now U.S. Pat. No. 6,470,902, which is a continuation-in-part of Ser. No. 09/490,860 filed Jan. 24, 2000 now U.S. Pat. No. 6,382,224, which is a continuation-in-part of Ser. No. 09/131,148 filed Aug. 7, 1998 now U.S. Pat. No. 6,041,800, and a continuation-in-part of Ser. No. 09/277,250 filed Mar. 26, 1999 now U.S. Pat. No. 6,076,312, which is a continuation of Ser. No. 09/025,897 filed Feb. 18, 1998 now U.S. Pat. No. 5,921,260, and a continuation of Ser. No. 08/823,616 filed Mar. 25, 1997 now U.S. Pat. No. 5,797,412, and a continuation of Ser. No. 08/604,801 filed Feb. 23, 1996 now U.S. Pat. No. 5,632,293, and a continuation of Ser. No. 08/279,476 filed Jul. 25, 1994 now U.S. Pat. No. 5,511,572.

BACKGROUND

This invention relates to devices that provide assistance in the ambulation of a patient, and, more particularly, to a improved ergonomic crutch that has reduced manufacturing costs and yet provides considerable versatility in its ability to be adjusted to the needs of the individual patient.

Currently, there are a variety of crutches available to patients and which have differing features. Perhaps one of the more common crutches employs dual upright members with a handle to be grasped by the user intermediate the two uprights. One problem with that design crutch is, of course, that the duplication of the uprights adds to the overall weight of the device and the location of the hand hold intermediate the two upright members is often uncomfortable to the patient with large hands that are squeezed between the relatively confined area between the two upright members. In addition, a useful and advantageous feature of crutches is the ability to be hung on the edge of a desk so that the crutch is readily accessible to the patient where the patient is able to conveniently reach the crutches. With the two upright member design, that feature is simply not present.

A further type of crutch that is also currently available is the so-called Shepherd's crutch and which is a singly curved tubular structure and which has a curved upper end with a plurality of bends for positioning under the arm of the patient. That type of crutch also has a handle for the patient's hands that extends horizontally outwardly from an intermediate area of the crutch, however, the upper underarm pad and the handle are parallel to each other and therefore the overall crutch is not ergonomically designed for the patient. The more comfortable construction is to have the underarm pad at a slight upward angle forwardly with respect to the hand grip. While overcoming some of the shortcomings of the previously describe crutch, the Shepherd's crutch suffers from other failings. The curved upper end is relatively expensive to manufacture with accuracy due to the multiple curves.

A further feature that is very desirable in crutches is in having the arm cradle, that is, the arm cradle and pad that fits under the arm of the patient, slope upwardly in the forward direction. Such forward slope enhances the ergonomic effect of the crutch in aiding to the comfort of the patient.

SUMMARY OF THE INVENTION

The present invention overcomes the difficulties of the aforementioned crutches by providing a crutch for assisting in the ambulation of a patient that comprises a unitary upright member. That unitary upright member includes an upper section, a lower section and has an intermediate section that forms an indentation that is generally angular with respect to the upper and lower sections. The upper and lower sections have longitudinal axes that meet, when extended, in a acute angle. Thus, in use, the lower section is in a generally vertical orientation while the upper section is angled slightly rearwardly with respect to the vertical. That rearward angle causes an inherent upward slope to the arm cradle and achieves the ergonomic goal while minimizing the expense of fabrication. The intermediate indented section has a generally horizontal handle that extends outwardly therefrom. The upper arm cradle is movably affixed to the upper section and is adjustable with respect to said upper section to selectively vary the distance between the arm cradle and the handle. A bottom member is adjustably affixed to the lower section to enable the bottom member to be positioned at a plurality of locations along said lower section to selectively adjust the position of said bottom member with respect to the lower section.

As such, the unique design of the present crutch allows comfortable, ergonomic fit to the individual patient and is adjustable to adapt itself to the particular patient. The indentation along with the horizontally extending handle, allow the crutch to be readily hung from a desk surface or a partition so that the crutch can remain within the easy reach of the patient when not in use. The use of a single unitary upright member allows the fabrication of the crutch at lower cost and yet provide a sturdy, safe construction. As a still further feature, since both the upper arm cradle and the bottom member are adjustably affixed to the unitary upright member, the crutch can be collapsed so that it takes up a minimum amount of space for storage. Additionally, by use of the rearwardly angled upper section, the arm cradle assumes a natural upwardly frontward slope without expensive modifications or complex additional manufacturing procedures.

Other objects, features and advantages of the present invention will be more apparent from the detailed description of the preferred embodiments set forth below, taken in conjunction with the accompanying drawings.

DETAILED DESCRIPTION OF THE INVENTION

Figure 1:
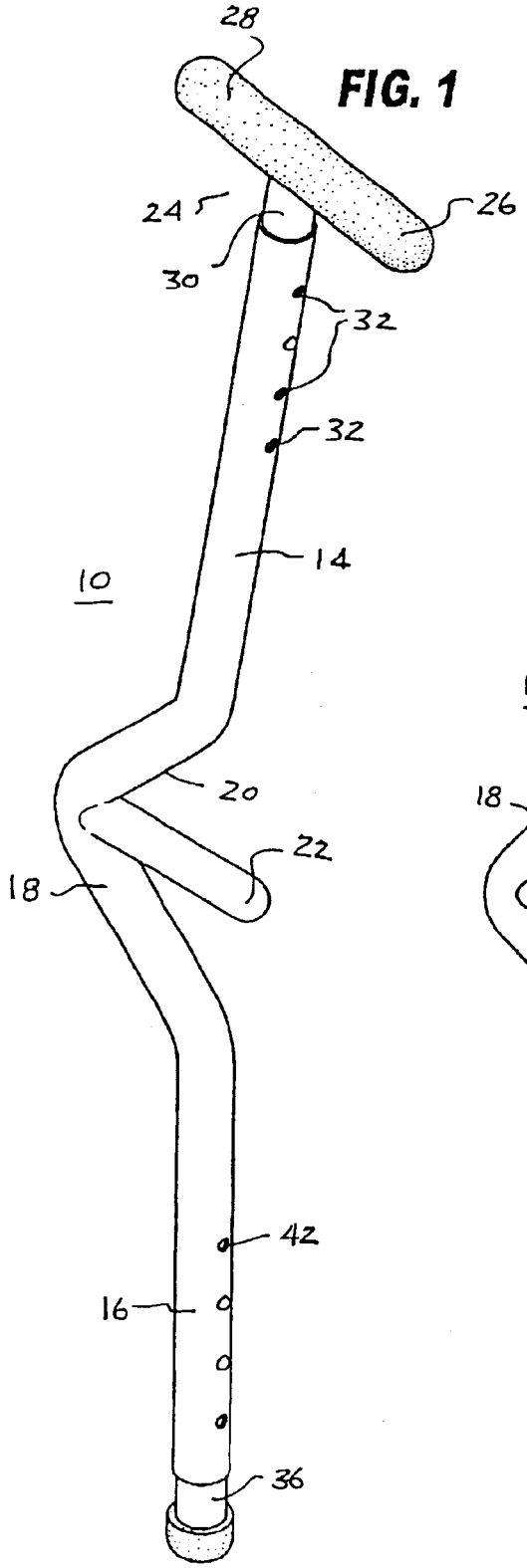
FIG. 1 is an isometric view of a crutch constructed in accordance with the present invention.
Figure 2:
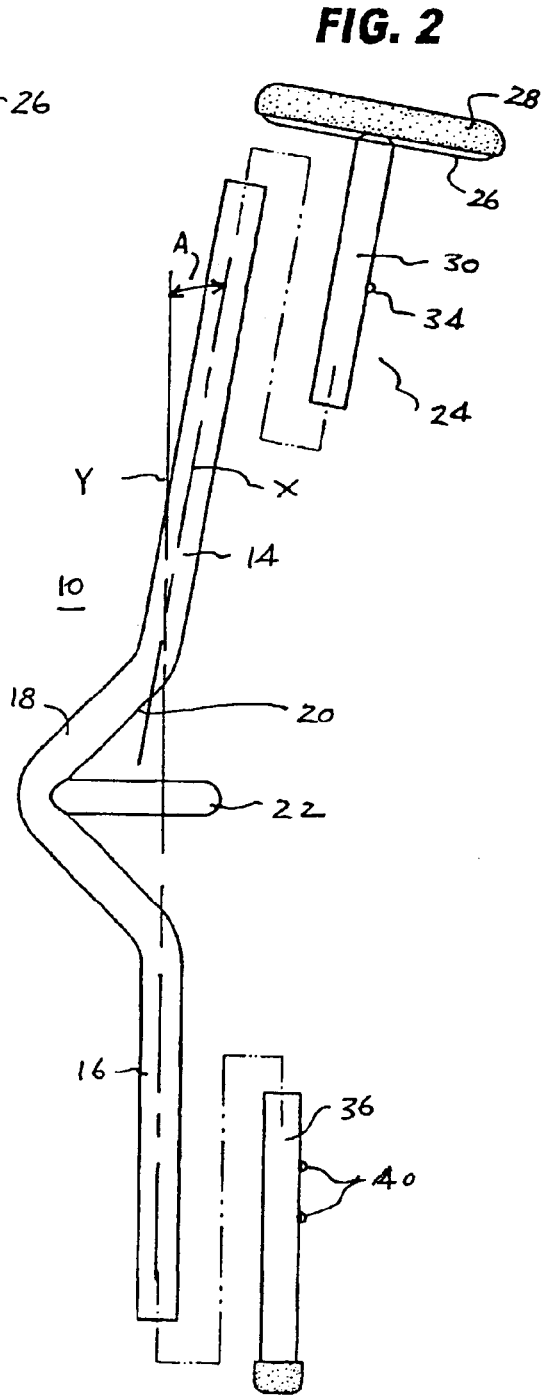
FIG. 2 is an exploded view of the crutch of FIG. 1 showing the assembly and disassembly of the present invention.
Figure 3:
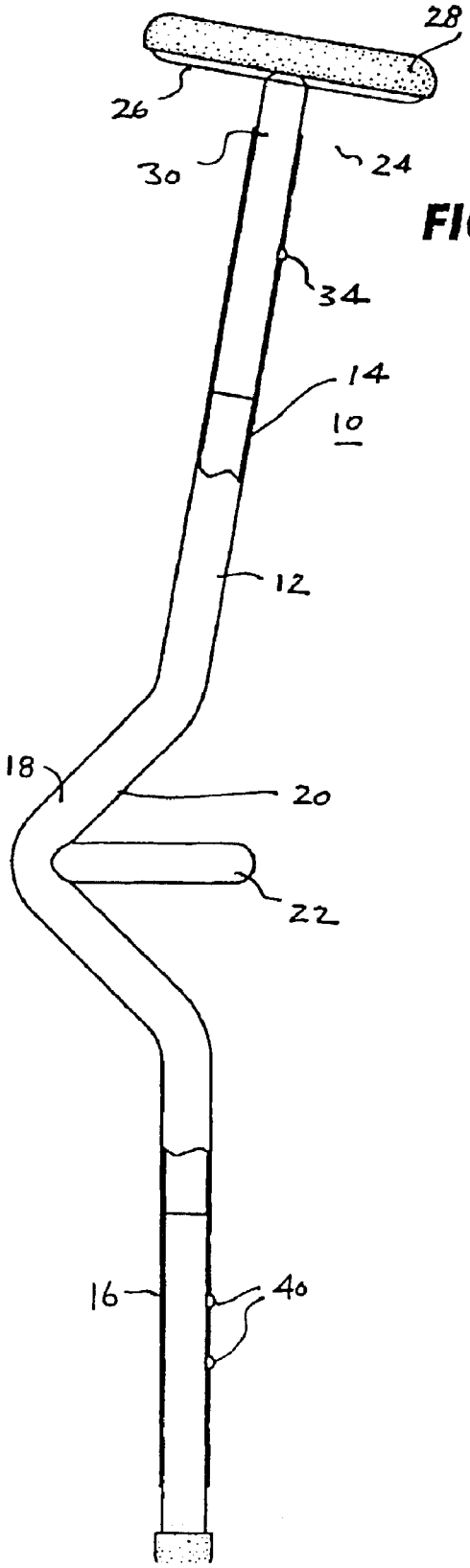
FIG. 3 is a side plan view of the crutch of FIGS. 1 and 2.

Referring now to FIGS. 1–3, there is shown an ergonomically improved crutch 10 constructed in accordance with the present invention. The crutch 10 includes a unitary upright member 12 that can be made of a tubular metal material such as aluminum or steel. As can be seen, particularly in FIG. 1, the unitary upright member 12 is a single piece of metal tubing so as to minimize the weight and to allow the ready shaping into the present desired configuration and comprises an upper section 14 that is a straight section, a lower section 16 that is also a straight section and an intermediate section 18 that forms an indentation 20 with respect to the straight configuration of the upper and lower sections 14 and 16.

The indentation 20 can be formed, as shown, as an angular indentation or may be an arcuate configuration, however, in either case, the indentation 20 is in the forward direction. As will be used herein, the forward direction will be described as the direction that the patient is facing when utilizing the crutch and the rearward direction will be referred to as the direction facing the rear of the patient when using the crutch.

Accordingly, the indentation 20 is indented in the forward direction and a handle 22 is formed extending rearwardly from the intermediate section 18 in a generally horizontal direction so as to be readily gripped by the patient in using the crutch 10.

As can be seen, the handle 22 therefore occupies the space that is generally in alignment with the upper section 14 and the lower section 16 and therefore is comfortable to the patient while allowing integrity of the overall construction of the crutch 10. As is also apparent, by the construction of the handle 22 as shown, the patient can easily locate a hand gripping the handle 22 and there is no discomfort by cramping the hand between two upright member no matter how large the hand is of the patient. In addition, by welding the handle 22 to the intermediate section 18, the resulting unit is extremely strong and will not readily break under the weight of the patient.

Again, briefly referring specifically to FIG. 1, it will be seen that the upper section 14 and the lower section 16 both have longitudinal axes, indicated as X and Y, respectively and the axes meet at an angle with respect to each other. That angle is indicated as angle A and is preferably about 5 degrees to about 15 degrees with the more preferable angle being about 10 degrees. Accordingly, in the use of the crutch 10, the lower section 16 is intended to be vertically oriented so that the crutch 10 and, of course, the patient is stable in walking with the device. The upper section, however, is inclined rearwardly at a slight angle. The purpose of the rearward angle and its effect on the ergonomics of the crutch 10 will be later explained.

An upper arm cradle 24 is provided at the top of the upper section 14 and is affixed to the upper section 14 so as to be adjustable with respect thereto, that is, the upper arm cradle 24 can be moved by the user through a plurality of positions extending from the upper section 14 so that the arm cradle 26 can be adjusted to fit the particular size of the patient and, as such, needs to be movable for the comfort to vary the distance between the cradle 26 and the handle 22 that is also in a fixed position. As is conventional, a resilient cover 28 is fitted over the cradle 26, again for the comfort of the patient. The upper arm cradle 24, as most clearly shown in the exploded view of FIG. 1, is in the form of a tee, having the cradle 24 affixed to, or constructed integral with, a cylindrical support 30. Preferably the cradle 26 can be welded to the cylindrical support 30.

Thus, the upper arm cradle 24 is adjustably secured to the upper section 14 by means of a telescoping arrangement wherein the cylindrical support 30 has a diameter that fits snugly within the upper section 14 so as to be slidably movable with respect to the upper section 14. The upper section 14 has a plurality of aligned, circular apertures 32 that are sized so as to receive a biased button 34 located in the cylindrical support 30 in conventional manner. As such, therefor the upper arm cradle 24 can be constructed easily in a conventional, manner and can be slid within the upper section 14 until the user reaches the proper, desired location and is then locked into position by means of the biased button 34 extending through one of the circular apertures 32. Obviously, to relocate the upper arm cradle 24 to another position, the biased button 34 can be pressed by the user to clear the circular aperture 32 and the cylindrical support 30 moved to a differing location and the biased button again locking the upper arm cradle 24 into the new position.

Therefore, the upper arm cradle can be moved to a plurality of locations to one that is the most comfortable to the patient and, as indicated, for storage, the upper arm cradle 24 can be moved to its innermost position so that the overall length of the crutch 10 is minimized.

As can now be seen, the rearwardly angled upper section 14 inherently creates an upwardly slope to the cradle 26 when the crutch 10 is assembled, that is, when the tee shaped upper arm cradle 24 is secured to the end of the upper section. Thus, the upwardly inclined cradle 26 can be inexpensively formed, without complex arrangements, by the simple expedient of forming the upper section with a slight rearward angle. As such, standard components can be used and still have the desired upward slope of the arm cradle. The natural upwardly slope of the arm cradle thus creates a non-parallel relationship with the handle so that the comfort of the patient is enhanced by having the longitudinal axis of the upper cradle at an angle with respect to the longitudinal axis of the handle. The slight angle between the cradle 26 and the handle also provides an ergonomic effect to the user where the hand falls naturally on to the handle at the angle formed between the handle and the upper cradle so that the patient has a comfortable stance. That ergonomic property is not present when the upper cradle and the handle grasped by the patent have longitudinal axes that are parallel.

In somewhat similar fashion, a bottom member 36 is affixed to the lower end of the lower section 16 and, again, in the preferred embodiment, the bottom member 36 is fitted in telescoping manner by means of a cylindrical member 38 that interfits within the internal diameter of the lower section. The bottom member 36 may have a plurality of biased buttons 40, two are shown, and which extend through the circular apertures 42 when the bottom member 36 is located by the user into the desired position. As with the upper arm cradle 24, the bottom member 36, in conventional manner, can be moved to the desired position extending from the lower section 16 for the comfort of the patient depending on the size of the patient and the like. In addition, again, where it is desired to store the crutch 10, for example under a seat, the bottom member 36 can be moved to its innermost position so as to minimize the overall length of the crutch 10.

Accordingly, as can be seen, the present invention attains all of the desirable features for crutches and achieves good ergonomics through a relatively inexpensive manufacturing processes. The balance of the crutch 10 allows it to be hung from a desk or wall partition and therefore be within the easy grasp of the patient Additionally, the handle is of a strong construction and can comfortable accommodate ever very large hands. Due to the unique angle of the upper section, the cradle 26 assumes a natural upward slope that is comfortable to the patient without elaborate or expensive means to achieve that result.

In addition, the rearwardly directed angle of the upper section 14 with respect to the lower section 16 brings about a natural placement of the wrist for grasping the handle 22, that is, the angle allows the patient's arm to fall naturally vertically downward such that the location of the hand gripping the handle is in a vertical alignment with the patients's underarm and the lower section where contact is made with the surface on which the patient is ambulating. As such, therefore, the patient can grip the handle in a natural manner and support is provided in a generally vertical alignment between the contact with the ground, the grip by the patient of the handle and the positioning of the cradle 26 under the arm of the patient. The natural and ergonomic result is that the weight of the patient is carried by the handle with the wrist in a comfortable, stable position so that as the crutch swings with the natural walking movement of the patient, the wrist is not stressed but remains in a comfortable stance. The further ergonomic result is in the arm being positioned in its natural position vertically downward and thus there is less stress to the patient's wrist as the patient carries out the normal movement of the crutch in ambulating.

Although the present invention has been described in conjunction with one of its embodiments, it is to be understood that modifications and variations may be resorted to without departing from the spirit and scope of the invention as those skilled in the art readily understand. Such modifications and variations of the invention are considered to be within the purview and scope of the invention and the appended claims.

I claim:

1. A crutch for assisting in the ambulation of a patient wherein said crutch is oriented with a forward direction in the direction the patient is facing and a rearward direction opposite therefrom, said crutch comprising a unitary upright member said unitary upright member having an upper section, a lower section and an intermediate section therebetween forming an indentation having an regular configuration and extending outwardly form said upper and lower sections in the forward direction, said upper and said lower sections having longitudinal axes, said intermediate section having a generally horizontal handle depending outwardly therefrom in the rearward direction, an upper arm cradle movably affixed to said upper section and being adjustable with respect to said upper section to selectively vary the distance between said arm cradle and said handle, said upper arm cradle having a main longitudinal axis disposed at an angle with respect to said generally horizontal handle, and a bottom member adjustably affixed to said lower section to position said bottom member at a plurality of locations along said lower section to selectively adjust the position of said bottom member with respect to said lower section, wherein said lower section and said upper sections are at an angle with respect to each other, and said upper section is disposed at an acute angle determined with respect to the longitudinal axis containing said lower section and extends in said rearward direction when said crutch is in use.

2. A crutch for assisting in the ambulation of a patient as defined in claim 1 wherein said upper arm cradle is affixed to said upper section by telescoping said upper arm cradle within said upper section and wherein said upper arm cradle is movable between a plurality of locked positions affixed to said upper section.

3. A crutch for assisting in the ambulation of patient as defined in claim 2 wherein said upper section has a plurality of circular apertures and wherein said upper arm cradle has a cylindrical support extending into said upper section and said cylindrical support has at least one biased button adapted to extend through at least one of said apertures to fix said upper arm cradle into its lacked position.

4. A crutch for assisting in the ambulation of a patient as defined in claim 1 wherein said upper section is angled rearwardly with respect to the longitudinal axis containing said lower section at an angle of between about 5 degrees and about 15 degrees.

5. A crutch for assisting in the ambulation of a patient as defined in claim 4 wherein said longitudinal axis of said upper section is angled rearwardly about 10 degrees.

6. A crutch for assisting in the ambulation of patient as defined in claim 4 wherein said upper arm cradle comprises a cradle for supporting a patient and a cylindrical support forming tee with said cradle, and wherein said cylindrical support extends into said upper section, said cradle having forwardly directed upward slope at generally a right angle to the longitudinal axis of said upper section.

7. A crutch for assisting in the ambulation of patient as defined in claim 6 wherein said longitudinal axis of said cradle is at an acute angle with respect to said longitudinal axis of said horizontal handle.

* * * * *